US005399216A

United States Patent [19]

Galchefski et al.

[11] Patent Number: 5,399,216

[45] Date of Patent: Mar. 21, 1995

[54] APPARATUS AND METHOD FOR APPLYING LABELS ONTO SMALL CYLINDRICAL ARTICLES USING PRESSURE APPLICATOR TO PREVENT LABEL MISMATCHING

[75] Inventors: John M. Galchefski, Larksville, Pa.; Ian Westbury, Turlock, Calif.; John Stevenson, Kingston, Pa.

[73] Assignee: CMS Gilbreth Packaging Systems, Trevose, Pa.

[21] Appl. No.: 62,952

[22] Filed: May 14, 1993

Related U.S. Application Data

[63] Continuation-in-part of Ser. No. 906,573, Jun. 30, 1992.

[51] Int. Cl.[6] ..... B65C 9/00

[52] U.S. Cl. ..... 156/215; 156/86; 156/449; 156/456; 156/488; 156/567

[58] Field of Search ..... 156/215, 256, 281, 308.6, 156/308.8, 314, 446, 449, 450, 456, 520, 566, 567, 568, 578, 521, 488, 86

[56] References Cited

U.S. PATENT DOCUMENTS

| | | | |
|---|---|---|---|
| 2,703,660 | 3/1955 | Von Hofe et al. | 216/55 |
| 3,235,433 | 2/1966 | Cvacho et al. | 156/229 |
| 3,577,293 | 5/1971 | Ritterhoff | 156/187 X |
| 3,604,584 | 9/1971 | Shank, Jr. | 215/12 R |
| 3,659,394 | 5/1972 | Hartleib et al. | 53/33 |
| 3,765,991 | 10/1973 | Hoffmann | 156/521 |
| 3,834,963 | 9/1974 | Hoffman | 156/256 |
| 3,878,960 | 4/1975 | Jonsson et al. | 215/12 R |
| 4,108,709 | 8/1978 | Hoffmann | 156/446 |
| 4,108,710 | 8/1978 | Hoffmann | 156/450 |
| 4,108,711 | 8/1978 | Hoffmann | 156/497 |
| 4,124,433 | 11/1978 | Herdzina et al. | 156/456 |
| 4,207,832 | 6/1980 | Bowman et al. | 118/212 |
| 4,242,167 | 12/1980 | Hoffmann | 156/357 |
| 4,323,416 | 4/1982 | Malthouse et al. | 156/521 |
| 4,336,095 | 6/1982 | Hoffmann | 156/361 |
| 4,366,016 | 12/1982 | Golden, Jr. | 156/218 |
| 4,406,721 | 9/1983 | Hoffmann | 156/86 |
| 4,416,714 | 11/1983 | Hoffmann | 156/86 |
| 4,425,866 | 1/1984 | Hoffmann | 156/58 |

(List continued on next page.)

FOREIGN PATENT DOCUMENTS

| | | |
|---|---|---|
| 1012906 | 6/1977 | Canada . |
| 1106653 | 3/1968 | United Kingdom . |

*Primary Examiner*—David A. Simmons
*Assistant Examiner*—James J. Engel
*Attorney, Agent, or Firm*—Richard K. Warther

[57] ABSTRACT

An apparatus and method for applying thin film polymer labels to small cylindrical articles such as dry cell batteries without label mismatching is disclosed. A label transport drum is rotatably mounted on a frame. Cut labels are supplied to the surface of the label transport drum as the drum is rotated. An adhesive is applied onto the area adjacent the leading edge of the label while the label is moving with the drum, and a solvent is applied onto an area adjacent the trailing edge of the label. Cylindrical articles are conveyed in tangential spinning engagement with the label transport drum and into rotative engagement with the adhesive on the leading edge of the label so as to transfer the label onto the article as the label is moved into engagement with the rotating article. A pressure plate imparts pressure against selected sides and ends of the article during wrapping to prevent mismatching of the label as the label wraps around the article. A seam is formed at the overlap of leading and trailing edge portions. The pressure plate has an article engaging surface positioned adjacent the surface of the drum. The camber of the plate may be varied relative to the articles conveyed on the surface of the drum, thus varying the pressure imparted against selected areas of the article during labeling to prevent mismatching of the label.

28 Claims, 7 Drawing Sheets

U.S. PATENT DOCUMENTS

| | | | |
|---|---|---|---|
| 4,443,285 | 4/1984 | Roth et al. | 156/215 |
| 4,447,280 | 5/1984 | Malthouse | 156/85 |
| 4,496,409 | 1/1985 | Kontz | 156/85 |
| 4,500,386 | 2/1985 | Hoffman | 156/449 |
| 4,526,645 | 7/1985 | Malthouse et al. | 156/350 |
| 4,544,431 | 10/1985 | King | 156/256 |
| 4,545,832 | 10/1985 | Hoffmann | 156/86 |
| 4,561,928 | 12/1985 | Malthouse | 156/497 |
| 4,574,020 | 3/1986 | Fosnaught | 156/80 |
| 4,604,154 | 8/1986 | Fosnaught | 156/264 |
| 4,632,721 | 12/1986 | Hoffmann et al. | 156/458 |
| 4,662,925 | 5/1987 | Thimons et al. | 65/104 |
| 4,671,836 | 6/1987 | Fumei | 156/215 |
| 4,686,931 | 8/1987 | DiFrank | 118/50 |
| 4,693,210 | 9/1987 | DiFrank | 156/259 |
| 4,694,633 | 9/1987 | Fujio et al. | 53/49 |
| 4,704,173 | 11/1987 | Hoffman | 156/86 |
| 4,724,037 | 2/1988 | Olsen | 156/578 |
| 4,726,872 | 2/1988 | Olsen | 156/455 |
| 4,729,811 | 3/1988 | DiFrank | 156/449 |
| 4,735,668 | 4/1988 | Hoffmann | 156/215 |
| 4,749,428 | 6/1988 | Dickey . | |
| 4,761,200 | 8/1988 | Szeremeta | 156/448 |
| 4,772,354 | 9/1988 | Olsen et al. | 156/578 |
| 4,781,785 | 11/1988 | Szeremeta | 156/448 |
| 4,832,774 | 5/1989 | DiFrank et al. | 156/215 |
| 4,844,760 | 7/1989 | Dickey | 156/215 |
| 4,844,957 | 7/1989 | Hoffman | 428/34.7 |
| 4,923,557 | 5/1990 | Dickey | 156/86 |
| 4,931,122 | 6/1990 | Mitchell | 156/215 |
| 4,977,002 | 12/1990 | Hoffman | 428/34.7 |
| 4,984,413 | 1/1991 | Cosmo | 53/465 |
| 5,037,499 | 8/1991 | Bright et al. | 156/456 |
| 5,045,140 | 9/1991 | Dickey | 156/215 |
| 5,078,826 | 1/1992 | Rogall | 156/451 |
| 5,091,040 | 2/1992 | Otruba | 156/566 |
| 5,091,239 | 2/1992 | Przeworski et al. | 428/195 |
| 5,116,452 | 5/1992 | Eder | 156/566 |

APPARATUS AND METHOD FOR APPLYING LABELS ONTO SMALL CYLINDRICAL ARTICLES USING PRESSURE APPLICATOR TO PREVENT LABEL MISMATCHING

This application is a continuation-in-part application of U.S. Patent application Ser. No. 07/906,573, filed Jun. 30, 1992, entitled "Apparatus And Method For Applying Labels Onto Small Cylindrical Articles," which is incorporated herein by reference.

FIELD OF THE INVENTION

This invention relates to an apparatus and method for applying labels onto small cylindrical articles and more particularly to an apparatus and method for applying small, high quality thin film labels onto small cylindrical articles such as dry cell batteries while avoiding label mismatching during label wrapping.

BACKGROUND OF THE INVENTION

In the copending parent patent application Ser. No. 07/906,573, filed Jun. 30, 1992, small articles such as dry cell batteries, lipstick containers, lip balm containers and the like are labeled with high quality, thin film polymeric labels. An adhesive is applied by printing onto an area adjacent the leading edge of the label and a predetermined amount of solvent is evenly applied onto the area adjacent the trailing edge of the label. The articles are wrapped, securing first the leading edge, followed by overlapping the trailing edge onto the leading edge. The articles having wrapped labels applied thereto are then heated. The apparatus provides for high quality cylindrical labeling of small articles such as dry cell batteries using thin film, polymeric labels, e.g., typically less than 0.0035 inches thickness.

Beneficial solvent application is obtained when a pattern of solvent is applied to the label by the use of a rotating wiper tip which holds the solvent captive on the edge of the flexible wiper tip. In one disclosed embodiment of the invention, the wiper tip includes a V-notch for holding captive the solvent. As the wiper tip moves at the same surface speed as the label transport drum, the wiper tip is deflected against the trailing edge of the label, and the solvent is evenly transferred to the label. In another embodiment, a flexible, tapered tip evenly applies solvent onto the label when the surface speed of the wiper tip is different from the surface speed of the label and drum.

In one embodiment, the speed differential between the wiper tip and the label causes application of a "bead" of solvent at the point of departure of the wiper from the label, at a point adjacent to, but spaced from the trailing edge of the label. When the wiper moves slower then the surface speed of the label transport drum, the solvent is wiped toward the trailing edge of the label. If the wiper tip is moving faster than the surface speed of the label transport drum, the solvent is wiped from the trailing edge of the label forward. As the article rolls back over the solvent during wrapping, the weight of the article pushes the solvent evenly across the pretreated area on which the solvent was applied onto the trailing edge, thus in essence obtaining a more even solvent wipe along the trailing edge of the label.

This high quality labeling of small articles, such as dry cell batteries requires precision labeling without mismatching the label ends as the article is wrapped.

Such mismatching can occur if the label is skewed relative to the article during wrapping. For example, the labels often have printed matter with colored vertical zones, lettering and other associated trade logos that must align and match when the seam is formed between leading and trailing edges. Any label mismatch between leading and trailing edges would be unacceptable.

It has been found that wrap around labeling as heretofore described sometimes mismatches smaller labels as they are wrapped onto smaller cylindrical articles at high operating speeds. The physical dynamics of wrapping these smaller cylindrical articles with a small label makes control over such processes difficult without adequate means for ensuring correct alignment and matching of label ends during wrapping. Such article alignment means not only should compensate for different article and label sizes but also should compensate for production exigencies as they arise.

SUMMARY OF THE INVENTION

It is therefore an object of the present invention to provide an apparatus and method for applying thin film labels onto small cylindrical articles such as dry cell batteries where the label is evenly applied onto the article without label mismatching.

It is another object of the present invention to provide an apparatus for ensuring correct label alignment during wrap around labeling which can compensate for various article and label sizes and production exigencies as they arise.

These objects and other objects and advantages of the invention are set forth in the description which follows and, in part, will be obvious from the description and advantages being realized and entertained by means of the instrumentation, facts, apparatus, systems, steps and procedures, particularly pointed out in the specification.

In accordance with the present invention, labels formed from light weight, thin, polymeric sheet material are applied to small cylindrical articles such as dry cell batteries while obtaining well-defined, high quality seams between overlapping leading and trailing edges of the label without mismatching of the label. The labels are fed onto the surface of the label transport drum. The adhesive is applied by printing onto an area adjacent the leading edge of the label while the label is moving with the label transport drum. A predetermined amount of solvent is applied onto the area adjacent the trailing edge of the label. The articles are conveyed in tangential spinning engagement with the drum. As the drum rotates further, the leading edge of the label moves into rotative engagement with the adhesive positioned on the leading edge of the label to secure the label onto the article. The label wraps around the rotating article. The trailing edge overwraps the leading edge. The solvent forms a weld, securing the label in its wrapped condition.

It has been found in accordance with the present invention that when a desired pressure is imparted against selected areas of the sides and ends of the article during wrapping, label mismatching is avoided and a high quality seam is better assured at the overlap of leading and trailing edge portions. For example, if greater pressure is placed on the inside of the article as it rolls along the surface of the drum, the article tends to roll to its outside, and vice-versa. If during the high speed labeling, it is found that the applied labels become mismatched and the label ends between leading and trailing edges do not align correctly, then pressure may be exerted on selected sides or ends of the article to align the label correctly.

The apparatus includes a pressure plate having an article engaging surface positioned adjacent the surface of the label transport drum. The pressure plate is supported in spaced relation to a support plate. The support plate is mounted for movement on the frame relative to the label transport drum so that the pressure plate and support plate can be moved as a combined assembly to and from the surface of the label transport drum.

In one embodiment, biasing means in the form of spring members connect the two plates. A plurality of threaded control rods are received through the support plate. Each control rod has an end portion engaging the pressure plate. Each control rod is threadably adjustable for varying the camber between the article engaging surface of the pressure plate and articles engaging therewith, thus resulting in varying the pressure against selected sides and ends of the article so as to align the article and label correctly for proper, matched labeling and end-to-end alignment.

In a preferred embodiment, two spaced threaded rods extend through the support plate, each rod having an end portion engaging a respective side of the pressure plate. Both rods have right hand threads. The other ends of the rods extend through the support plate and have a spur gear connected at each end. The spur gears intermesh with each other. A pinion gear intermeshes with one of the spur gears. As the pinion is rotated the spur gears move in opposite directions, one counterclockwise, the other clockwise. As the spur gears rotate, one rod moves toward the pressure plate and exerts more pressure against one side of the pressure plate while the other backs away, lessening the pressure on the other side. As a result, the camber of the pressure plate changes and the pressure exerted against respective sides of the article changes, resulting in the desired wrapping. The pressure plate is readily adjusted by rotation of a shaft and universal joint combination connected to the pinion. This adjustment can be automatic.

DESCRIPTION OF THE DRAWINGS

The foregoing and other objects and advantages of the present invention will be appreciated more fully from the following description, with references to the accompanying drawings in which.

DETAILED DESCRIPTION OF THE INVENTION

Figure 1A:
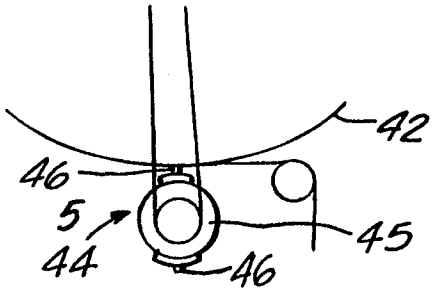
FIG. 1A is a schematic illustration of a label cutting assembly used for cutting labels on the drum.
Figure 1B:
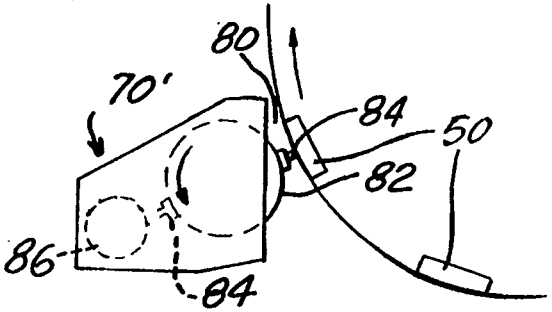
FIG. 1B is a schematic illustration of a solvent wiper mounted for rotation adjacent the label transport drum.
Figure 1:
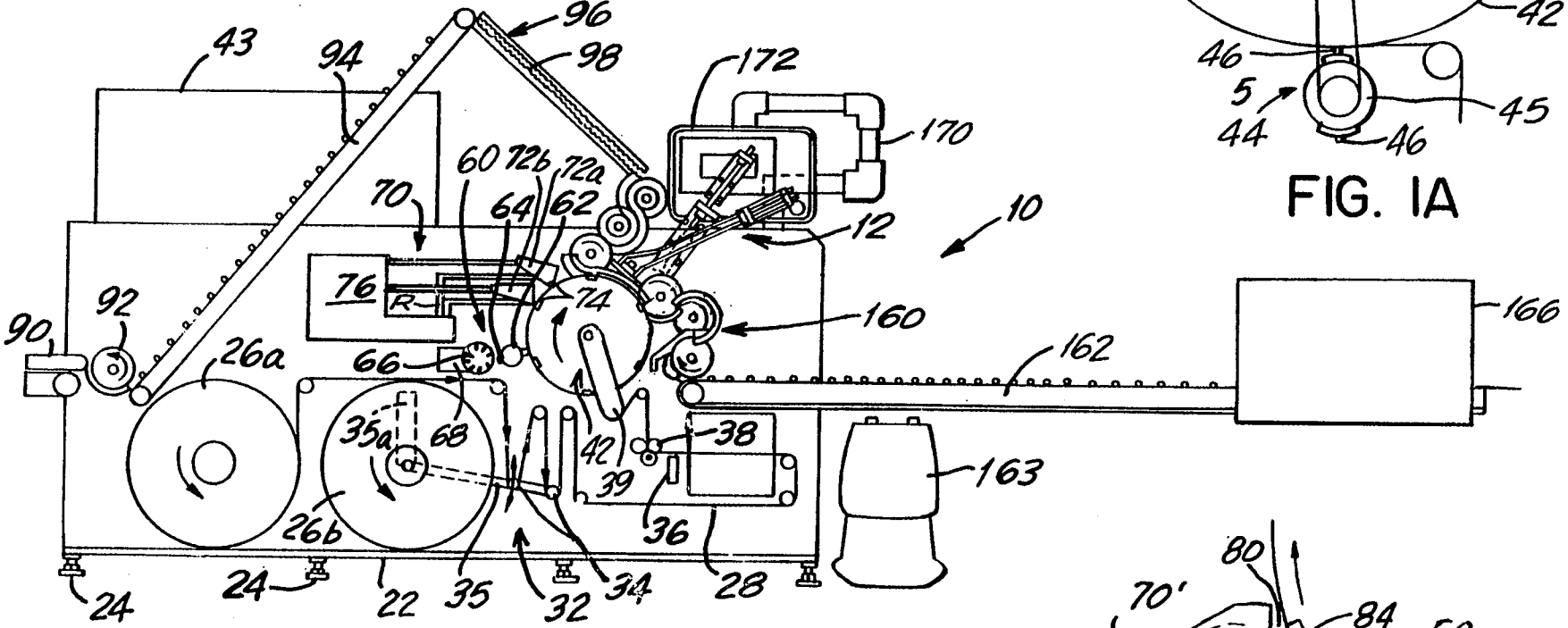
FIG. 1 is a schematic, side elevation view of the article labeling apparatus in accordance with present invention showing schematically the pressure applicator assembly that applies pressure onto the articles to ensure proper, matched labeling.

Referring now to FIG. 1, there is illustrated at 10 an apparatus for applying a high quality, thin film polymeric label (L) to a small cylindrical article such as a dry cell battery while forming a seam of high quality. The apparatus 10 is suitable for high quality cylindrical labeling of small cylindrical articles such as dry cell batteries requiring thin labels with a thickness typically less than 0.0035 inches. Throughout the description, the small cylindrical articles to be labeled will be referred to as articles, and will be given the reference letter "A". The apparatus 10 may be used for wrapping a label around a large variety of different small articles requiring high quality labels, such as dry cell batteries, lip balm containers, lipstick tubes and other similar articles. Such high quality labeling requires end-to-end label alignment without mismatching, so that different colored zones, lettering, and trade logos printed on the label are aligned correctly after the article is wrapped (FIG. 11B).

Figure 11A:
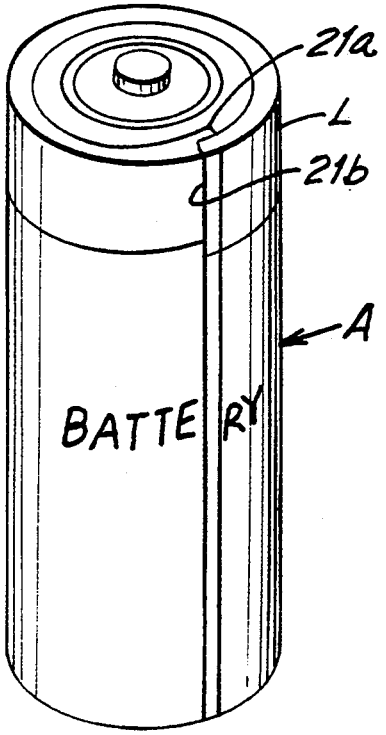
FIG. 11A is a pictorial view of a dry cell battery showing a mismatched label applied thereto.
Figure 11B:
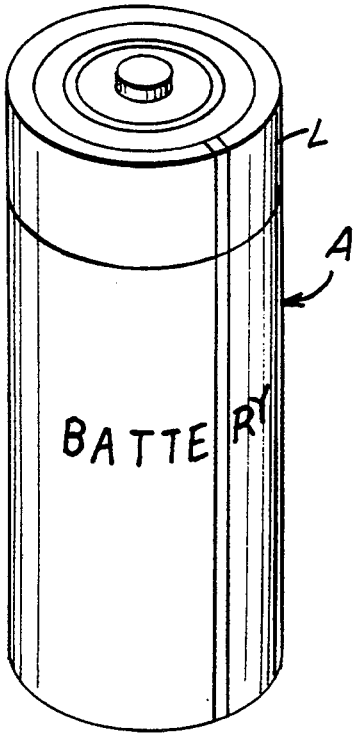
FIG. 11B is a pictorial view of a dry cell battery showing a properly matched and aligned label.

A pressure applicator assembly is indicated generally at 12, and provides the means for imparting a desired pressure onto selected areas of the sides and ends of the article during wrapping to ensure end-to-end alignment of the wrapped labels and prevent mismatching of the label during wrapping (FIGS. 11A and 11B).

In accordance with the present invention, the apparatus 10 includes a frame 22 for supporting major components such as a label transport drum, adhesive and solvent applicators, and rolls of continuous label material. The frame 22 includes leg supports 24 for supporting the frame on the floor. Two rolls *26a, 26b* of label material are supported for rotation on the frame. The rolls *26a, 26b* may include unwind drive motors (not shown) and other tensioning mechanisms for unwinding the film and applying tension to the rolls during withdrawal of film.

Figure 12:
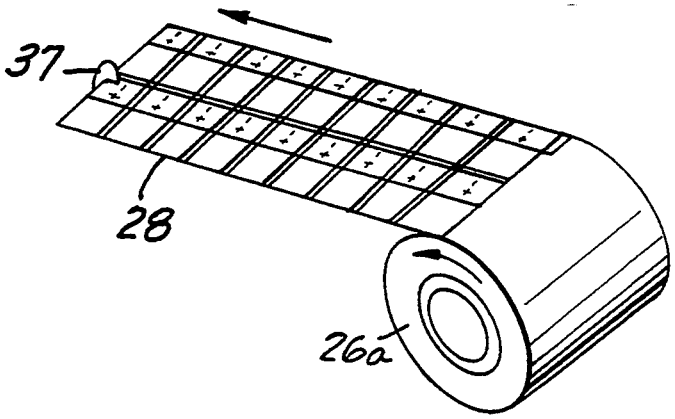
FIG. 12 is a pictorial view of a dual printed roll of label material having a strip of dry cell battery label material unwound therefrom.

The label material is pre-printed with identifying indicia used on the label (FIG. 12). Alternatively, a printing stamp or roller (not shown) may be positioned adjacent the label roll for printing directly onto the label material as it is withdrawn from the supply roll. The illustrated apparatus 10 is designed for wrapping articles fed in parallel pairs to each other. In this illustrated embodiment, each strip of label material has first and second continuous columns of printed indicia. During labeling, the strip 28 is longitudinally slit by a conveniently positioned slitter knife 37 (FIG. 12), and then horizontally slit as will be explained later to form cut labels of predetermined size having leading and trailing edges 21*a*, 21*b* respectively (FIGS. 11A and 11B).

The label material is formed from a heat shrinkable film material. Examples of acceptable film materials include those formed from polyvinyl chloride, polyester, and polystyrene. The label material typically has a thickness under 0.0035 inches, a thickness corresponding to the thinner material thickness commonly used for labeling smaller cylindrical articles such as dry cell batteries, lip balm and other similar containers with conventional sleeve technology where the sleeve is first formed on a mandrel and then transferred to an article, such as a dry cell battery. Typically, the articles are about 1.75 inches in diameter or smaller corresponding to the diameter of a "D" size or smaller dry cell battery. Because of the demanding label and seam quality requirements necessary for labeling these types of small articles, the labels heretofore have been pre-seamed on a continuous basis, and then applied as a sleeve to the article. A typical article size in which a high quality label was previously applied as a sleeve ranged in size usually less than one inch diameter.

As indicated in FIG. 1, label material is fed as a strip 28 from the first supply roll 26*a* into a dancer roll assembly 32 having a plurality of individual dancer rolls 34 connected to a dancer arm assembly 35. The strip 28 passes over a registration sensor 36, such as a fiber optic sensing element, registering the amount of label strip 28 withdrawn from the supply rolls 26*a*, 26*b*. An automatic splicer 37 may be incorporated into the feed line to splice the strip into the two strips (FIG. 12).

The strip 28 passes through a pair of feed rolls 38 rotating upwardly and outwardly from each other to aid in unwinding the strip and pulling it through the dancer roll assembly 32. The strip 28 passes over an idler roll and into an off-drum cutting assembly 39, where the film is cut into labels by means of a separate cutting drum and knife assembly (not shown in detail). The cut labels are then transferred onto the label transport drum, indicated generally at 42. Drive motors and transmission impart the force necessary for rotating the drum at a desired speed. The amount of film withdrawal and drum rotation are controlled by servomotors connected to feed rollers 38, encoders connected to the feed rollers and label transport drum, a controller 43, the registration sensor 36 for sensing position of the indicia corresponding to the label to be cut, and a dancer arm potentiometer 35*a* connected to the dancer arm. The controller maintains feed roll operation at a steady rate. The potentiometer 35*a* is linked to the pivot of the dancer arm and controls the speed of the unwind motor. As the dancer arm 35 is raised, the potentiometer 35*a* causes the unwind motor to rotate at a faster rate to feed out more film to the dancer roll assembly, thus lowering the dancer arm. The feed rolls 38 are rubber coated and powered by a closed loop servomotor system. The servomotor system feeds film at a rate that is proportional to the rate of the speed of the label transport drum. This is accomplished through a position feedback incremental encoder mounted on the label transport drum shaft and the sensed label position.

Alternately, the film may be cut by an "on the drum" cutting assembly (FIG. 1A) instead of the preferred "off drum" cutting assembly described before. As the strip is received onto the label transport drum 42, it is cut by a rotating knife assembly shown generally at 44. The knife assembly 44 can be the type described in the parent copending application Ser. No. 07/906,573, filed Jun. 30, 1992. The knife assembly 44 may include a cutting wheel 45 having opposing cutting blades 46 that engage the strip, cutting the strip into labels.

Figure 3:
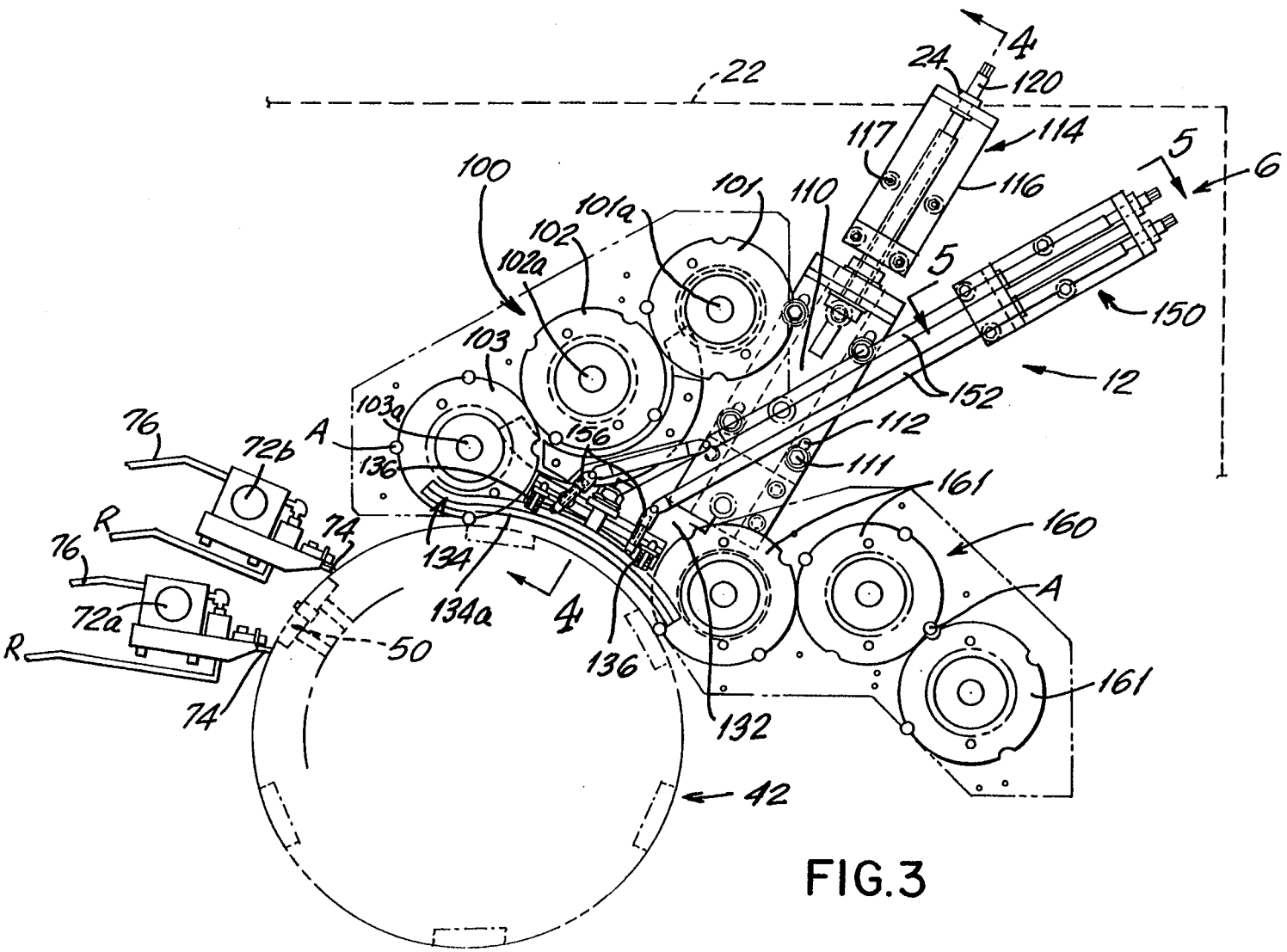
FIG. 3 is a schematic front elevation view of a first embodiment of the pressure applicator assembly of the present invention.

The label transport drum 42 includes label engaging drum inserts 50 having vacuum holes that engage and secure the leading and trailing edges and mid portion of the label to the drum as the drum rotates (FIG. 3). In the illustrated embodiment, six label retaining drum inserts 50 are evenly spaced around the periphery of the drum 42. As the labels are fed to the drum, the respective drum insert 50 holds the label to the drum surface by means of a vacuum drawn through manifolds (not shown) in the label transport drum and through the vacuum holes in the inserts 50.

As the vacuum secured label moves with the rotating drum 42, the leading edge of the label advances to a position adjacent to an adhesive applicator indicated generally at 60. One type of adhesive applicator which may be used for the present invention is described more fully in the parent patent application Ser. No. 07/906,573. The adhesive applicator 60 may include an adhesive application roller 62, with outwardly extending adhesive wipers 64 which act as pads for printing the adhesive onto the leading edge of the label. The adhesive wipers can be formed from a strip of resilient or other material. The wipers engage a rotating gravure roller 66 which transfers the adhesive to the wipers. The depth of indentations in the gravure roller 66 determines the amount of transferred adhesive. The gravure roller 66 engages an adhesive supply 68 to supply adhesive to the gravure roller.

The adhesive applicator 60 applies an adhesive to the area adjacent the leading edge 21*a* of the label. A cold adhesive is more desirable than a hot melt adhesive because a hot melt adhesive tends to distort the thin film label material, forming an adhesive joint of poor appearance and low seam quality. As used herein, the term cold adhesive is defined as those adhesives that are viscous at room temperature, as compared to conventional hot melt adhesives that are inherently solid at room temperature and which become viscous only at elevated temperatures. Potential cold adhesives could be water or solvent based adhesives with suspended solids, and potentially rubber-based solvent and latex adhesives. Other adhesive applicator mechanisms not described in the aforementioned copending patent application also could be used as long as adequate adhesive is neatly and aesthetically applied according to manufacturing and quality guidelines.

After the cold adhesive is applied to the area adjacent the leading edge of the label, a solvent application system, indicated generally at 70, evenly applies solvent without mottling or solvent streaking in a precise pattern to the area adjacent the trailing edge of the label. The preferred solvent is an organic solvent and reacts to the film material. THF has been found to be an acceptable solvent. The solvent reacts with the film material, softening the area adjacent the trailing edge to provide a tacky quality to that area, retaining the trailing edge to the leading edge in overlapping engagement when the label is circumferentially wrapped around the article. The solvent is preferably applied after the adhesive is applied, to ensure that the solvent does not evaporate before the trailing edge of the label has overlapped the leading edge. As illustrated, the adhesive applicator 60 is positioned behind the solvent application system 70 so that the label first engages the adhesive applicator 60, applying adhesive on to the leading edge.

In the illustrated embodiment of FIG. 1 the solvent application system 70 includes two static wiper assembly housings *72a, 72b* each one having outwardly extending wiper tips 74, such as formed from felt or a cloth covered felt. THF or other solvent is metered into the housing onto the tip 74 from a solvent reservoir 76.

The wiper body is formed from porous material such as felt which allows solvent to be applied by a drip feed system thereon. The solvent then can flow by means such as capillary action to the wiper tip. A preferred vacuum scavenge system meters the amount of solvent. One type of scavenge system which would be used is described in U.S. Pat. No. 4,844,760 to Dickey, the disclosure which is incorporated herein by reference. The return line "R" provides for scavenge capability, and is exposed to subatmospheric pressure, forming a vacuum draw. Preferably, each wiper assembly *72a, 72b,* has a corresponding reservoir 76 and scavenge systems.

The first wiper assembly *72a* cleans the trailing edge of the label—removing dirt and softening the trailing edge by applying a minor amount of solvent. The second wiper assembly *72b* applies the solvent that "bites" or "etches" into the film to provide the welding action needed to secure the trailing edge in overlapping, secured solvent-seal relationship to the leading edge of the label when the label is wrapped about an article. It is estimated that about twice as much solvent could be applied by the second wiper assembly *72b* than the first *72a* to provide for sufficient solvent-seal bonding.

The solvent application system of another embodiment is illustrated schematically in FIG. 1B (indicated generally at 70') and includes a wiper member, indicated generally at 80, formed as a drum 82 that is mounted for rotation adjacent the label transport drum. The drum 82 includes two outwardly extending, tapering, and narrowing flexible wiper tips 84. These wiper tips 84 are preferably formed from a resilient material, which is not highly reactive to the solvent. The flexible wiper tip 84 typically provides some resiliency to allow deflection of the wiper tip against the label and drum surface, while retaining at least some stiffness to exert a wiping force against the label. Materials which may be used include felt, a cloth covering a felt wiper member, a soft cord, some silicones and urethanes, as well as other materials that are not, highly reactive to the solvent, but have appropriate resilience for a wiper. The wiper tip 84 engages a gravure roller 86 and solvent is transferred from the gravure roller to the wiper tip 84.

In accordance with that illustrated embodiment, the wiper tip 84 is moved at a surface speed different from the surface speed of the rotating label transport drum. As the tip engages the area adjacent the trailing edge of the label, a bead of solvent is applied onto a finite area instead of being poorly applied as if by splashing. The solvent, such as THF, is about half as viscous as water. The solvent is prone to splashing and thus, the speed differential between the wiper tip and label transport drum has been found to be beneficial in controlling solvent application. The speed differential can be obtained by using a servomotor or elliptical gear arrangement.

In one embodiment the surface speed of the wiper tip 84 is faster than the surface speed of the label transport drum. In another embodiment, the surface speed is slower. This speed differential between a wiper tip and label moving with the drum is maximized with the use of the static wiper assemblies *72a, 72b,* which aid in applying solvent adjacent to, but spaced from the leading edge. After solvent application, as the article rolls back over the solvent penetrated area of the label, the article weight pushes the solvent back across that area to the trailing edge of the label. This rolling motion across the solvent penetrated area has the effect of producing two wipes with each one wiper tip application, causing a more even spreading of solvent.

As shown in greater detail in FIG. 1, the articles A are initially conveyed on a flat belt conveyor 90 and into a star transfer wheel 92. The star wheel 92 rotates, transferring the articles A one at a time into an inclined belt conveyor 94 to provide a sufficient head of articles for process flow control. The articles can be fed in a double row, in side-by-side manner, each pair of articles having complementary pairs of labels (FIG. 8) to be applied thereto. For purposes of illustration, FIG. 2 only shows one row of fed articles. The apparatus can be readily designed for working with either one or two rows of fed articles.

Figure 4:
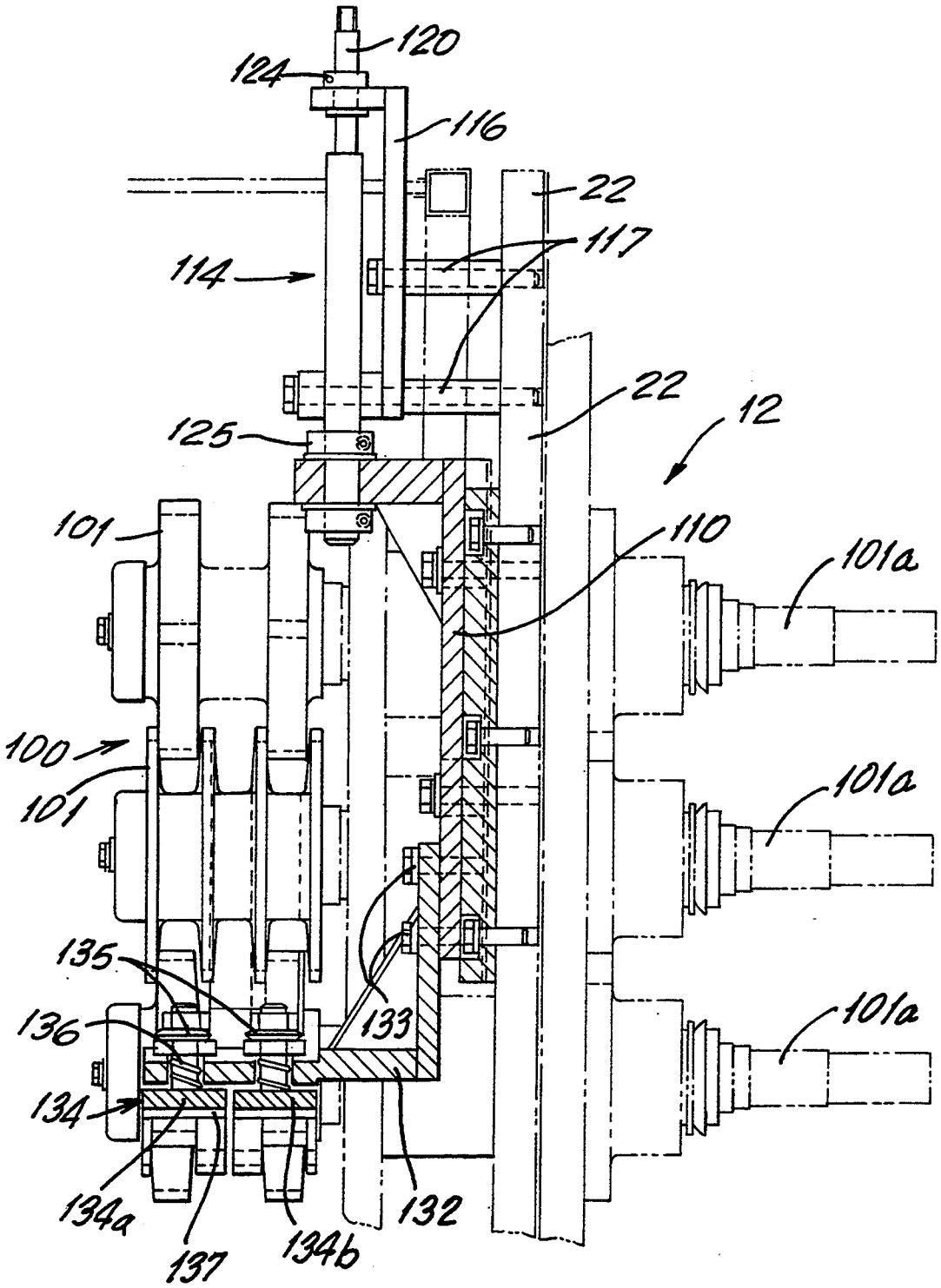
FIG. 4 is a sectional view of a first embodiment of the pressure applicator assembly taken along line 4—4 of FIG. 3.

The belt conveyor transports the articles A into an inclined gravity chute 96 having a serpentine channel 98 for slowing the movement of the articles A downward from the height of the inclined belt conveyor. Articles A then are fed into a serpentine timing wheel assembly, indicated generally at 100, where a tangential, rotative movement is imparted to the articles A. The articles A traverse around the serpentine timing wheel assembly 100, which includes three transfer wheels 101, 102, 103 rotatably mounted on spindles 101*a*, 102*a*, 103*a* connected to the frame 22 (FIG. 4). Each transfer wheel has article carrying positions 105 on which the articles are held and conveyed. As illustrated best in FIG. 2, the first transfer wheel 101 has twelve article carrying positions 105, the second transfer wheel 102 has eight, and the third 103 four. As the articles are accelerated in speed from movement from one transfer wheel to the next, the articles then engage an upwardly inclined front segment of a pressure plate in the pressure applicator assembly 12 which starts an article rolling. The articles then move into tangential spinning engagement with the surface of the label transport drum 42. The articles A traverse along the drum surface, held to the surface by the pressure applicator assembly 12 of the present invention, which also acts as a retaining shield. The label transport drum 42 rotates faster than the spinning articles, maintaining spin to the articles A initially produced by the transfer wheels 101, 102, 103.

Because the drum is rotating faster than the spinning articles A moving along the pressure applicator assembly 12, a label moves into engagement with an article. The article contacts the adhesive positioned adjacent the leading edge of the label. The adhesive provides a tacking agent to retain the label onto the article A. An upward flow of air is imparted against the label to push the leading edge of the label against the article A. The continued rotation of the article A wraps the label around the article A. The solvent positioned on the area adjacent the trailing edge provides a welding agent to the label at the point where the trailing edge portion overlaps the leading edge portion. During label wrapping the pressure applicator 12 of the present invention imparts onto the article A the desired pressure necessary to ensure that the label ends are aligned correctly and not mismatched.

Referring now to FIGS. 3–6, there are illustrated details of and embodiment of the pressure applicator assembly 12 of the present invention. The pressure applicator assembly 12 has a dual pad pressure control for ensuring adequate pressure is imparted onto each line of articles being fed in side-by-side manner along the label transport drum 42. The assembly 12 includes a U-shaped support flange 110 which is slidably mounted onto the frame 22 by fasteners such as bolts 111 engaging slots 112 formed in the support flange 110 (FIG. 3). The support flange 110 is movable on the frame in a direction generally toward and away from the surface of the label transport drum. A manual screw thread assembly, indicated generally at 114, provides for controlled movement of the flange 110. The assembly 114 includes a U-shaped threaded housing support 116 fixed to the frame by fasteners such as bolts 117 and a threaded rod 120 movable within the threaded housing support 116. One end of the threaded rod 120 connects to the support flange 110. The other end of the rod extends through the housing support 116 and is configured to receive a wrench to rotate the threaded rod 120, and move the support flange 110 in a direction generally toward and away from the label transport drum 42. A clamp collar 124 positioned on the upper surface of the housing support 116 receives the threaded rod 120 and can be turned to lock the threaded rod 120 and support flange 110 in a desired position. To ensure greater stability a second clamp collar 125 can be positioned on the lower portion of the housing support 116.

As shown in FIG. 3, a rectangular configured support plate 130 is fixedly mounted by means of an L-shaped bracket 132 to the support flange 110 by fasteners such as bolts 133. A rectangular configured, pressure plate member indicated generally at 134 is suspended by bolts 135 to the support plate. Spring elements 136 extend around the bolts 135. The pressure plate 134 is formed as a split plate, having two plate members **134*a*, 134*b*, (FIG. 4) each adapted for engaging a respective line of articles. The spring elements 136 bias the pressure plate outward from the support plate 130 and towards the label transport drum 42**.

The pressure plate 134 is arcuately configured substantially similar to the curvature of the outer surface of the label transport drum and has a lower article engaging surface **134*a* which engages the articles transported along the drum surface. A layer of resilient material 137, such as rubber, urethane or silicone is secured on the article engaging surface to provide a cushion for the articles A. The pressure plate 134 is initially curved upward to form an enlarged article entry area 140 that curves downward between the pressure plate 134 and surface of the label transport drum so as to start the articles rolling as they are guided onto the label transport drum 42 and against the article engaging surface 134*a*** of the pressure plate.

A control rod assembly 150 is connected to the support plate 130. The control rod assembly 150 adjusts the camber of the pressure plate 134 relative to the articles A conveyed along the label transport drum 42 so as to impart a desired pressure against selected sides or ends of the article A. For example, if greater pressure is applied to the inside of a conveyed article, the article tends to roll to the outside and vice versa. As a result, if the labels are wrapping around the article A and mismatching to the inside of the article, the control rod assembly 150 is adjusted to vary the camber of the pressure plate so it exerts greater pressure to the outside of the article and force inward the article so as to match the label end-to-end.

Figure 2:
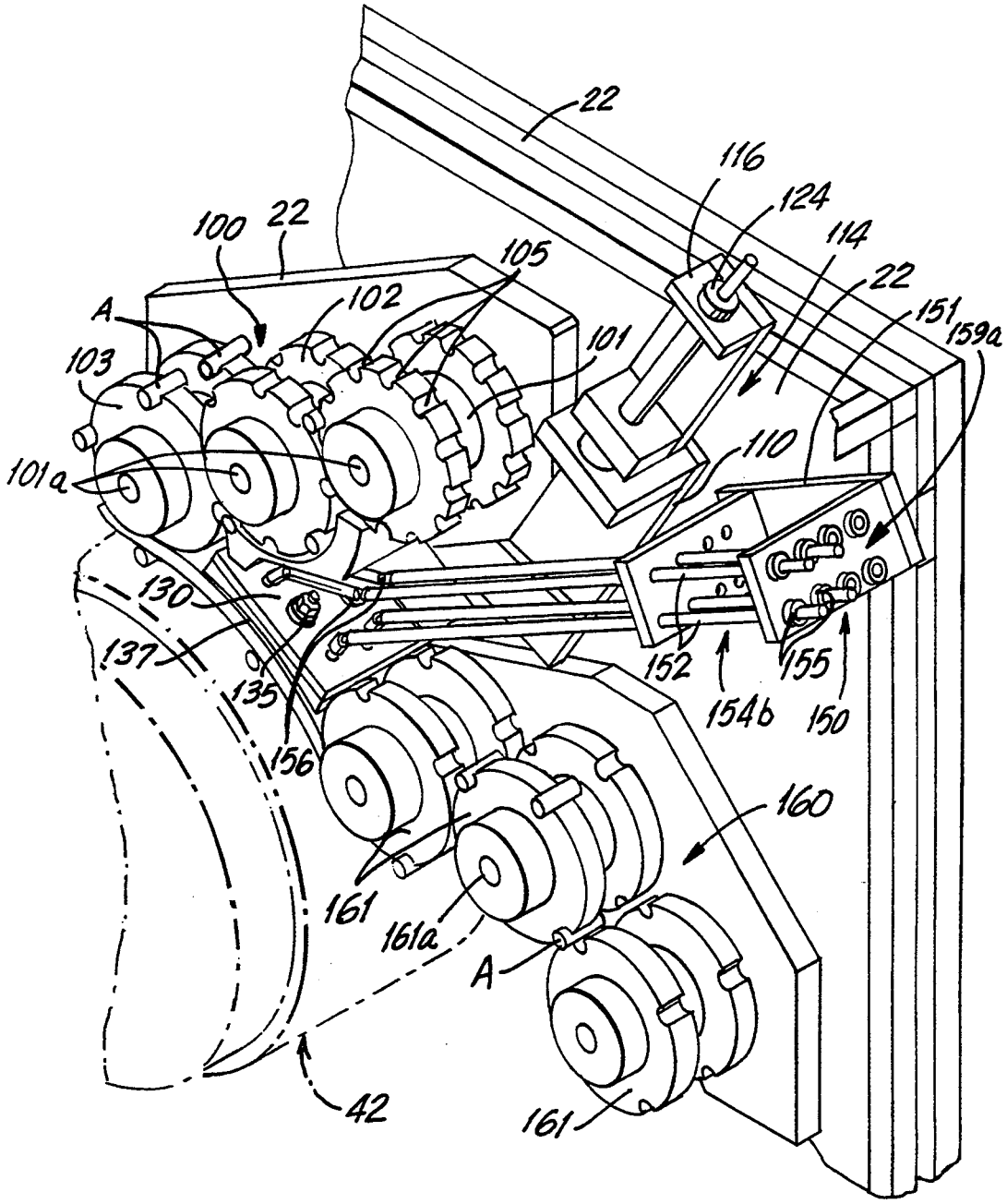
FIG. 2 is a pictorial view of a first embodiment of the pressure applicator assembly of the present invention showing in detail the pressure and support plates, and the control assembly.
Figure 5:
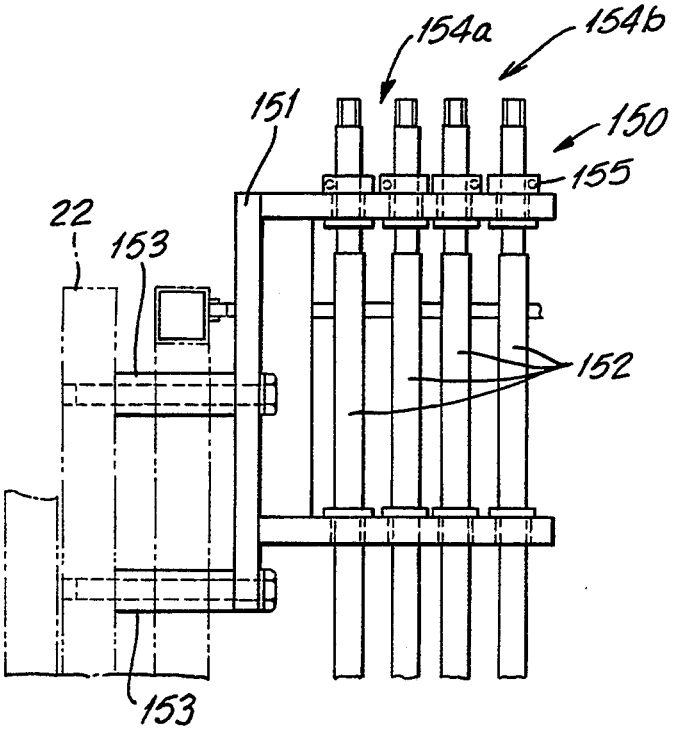
FIG. 5 is a plan view of a control rod assembly of the first embodiment taken along line 5—5 of FIG. 3.
Figure 6:
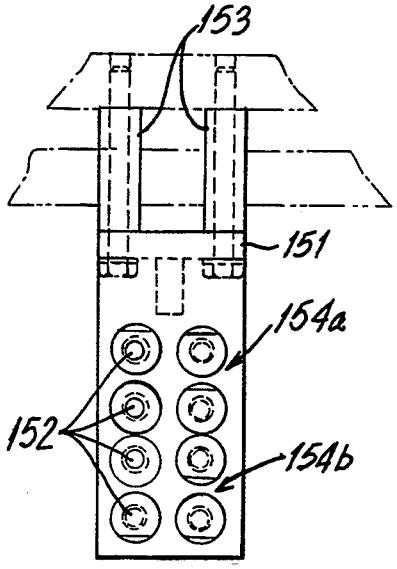
FIG. 6 is an end view of a first embodiment of the control rod assembly looking in the direction of arrow 6 of FIG. 3.
Figure 9:
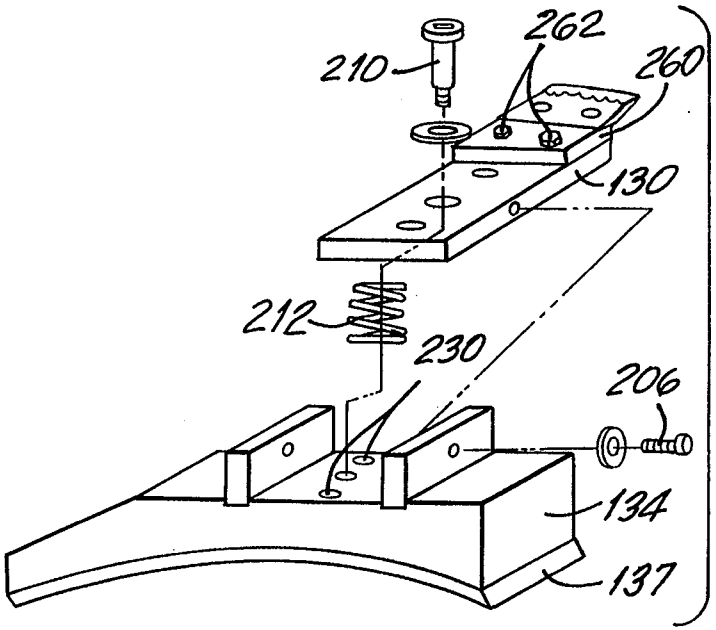
FIG. 9 is a schematic, exploded isometric view showing the relationship of the support and pressure plates.

As illustrated in FIGS. 3, 5, and 6, the control rod assembly 150 includes a U-shaped support bracket 151 fixed by fasteners such as bolts 153 to the frame 22. Eight control rods 152 are positioned as two groups **154*a*, 154*b* of four control rods (only one group is illustrated in FIG. 2) and extend through the support bracket 151 and engage the support plate 130. Each group of rods controls respective pressure plate members 134*a* and 134*b*. Each group of four rods interconnects the respective pressure plate members 134*a*, 134*b* by means of threaded pins 156 (FIG. 3) which extend through the support plate 130. Each threaded pin 156 has an end engaging the pressure plate 134. Two of the control rods 152 include a series of universal joints 156 which permit rotation of the control rods through a series of changing drive angles. Each control rod 152** is individually adjustable by rotation.

When a control rod 152 is turned and forced down, the end of the threaded pin 156 pushes against the pressure plate 134, changing the camber relative to the surface of the label transport drum 42 and against the articles A conveyed thereon. As a result, constant pressure control against the ends and sides of articles A may be maintained during labeling to ensure proper wrapping without mismatching of the labels. The individual control rods 152 are adjusted as needed so as to vary the camber of the pressure plate and vary the pressure against the article A. Typically, the control rods 152 are adjusted at the beginning of a production run and then on an "as needed" basis. The axial position of a control rod 151 relative to the support bracket 151 can be locked by lock nuts 155 which engage the control rods 152 so as to lock the camber of the pressure plate relative to the articles A.

The article A then progresses to a second serpentine timing wheel assembly 160 having in the illustrated embodiment three transfer wheels 161 rotatably mounted on spindles **161*a* which are supported by the frame (FIG. 2). The articles then progress onto a flighted bed belt conveyor 161. A laser marker 163 marks pertinent information on the wrapped article, such as serial numbers, battery expiration dates, and other factors. The conveyor 162 transports the articles into an oven 166 where the articles are heated and the label film heat shrunk around the articles A. A manual swing arm assembly 170 supports a modular control unit 172** (FIG. 1) providing access for a user to the machine controls.

Referring now to FIGS. 7 through 10, a second, more preferred embodiment of the pressure applicator 12 is illustrated. The pressure applicator of the second embodiment is advantageous over the first embodiment described above because a plurality of control rods do not have to be individually adjusted as in the first embodiment. In the first embodiment, some of the control rods 152 are turned forward, moving the rods against one area of the pressure plate 134, while other rods are manually moved in the reverse direction, reducing pressure from another area of the pressure plate 134.

In the second embodiment only one control shaft is turned. For purposes of description, similar elements of the second embodiment corresponding to similar elements of the first embodiment are illustrated with the same reference numeral. Other dissimilar structural elements or similar elements having substantially changed configurations are given identifying numerals in starting in the 200 series.

Figure 7:
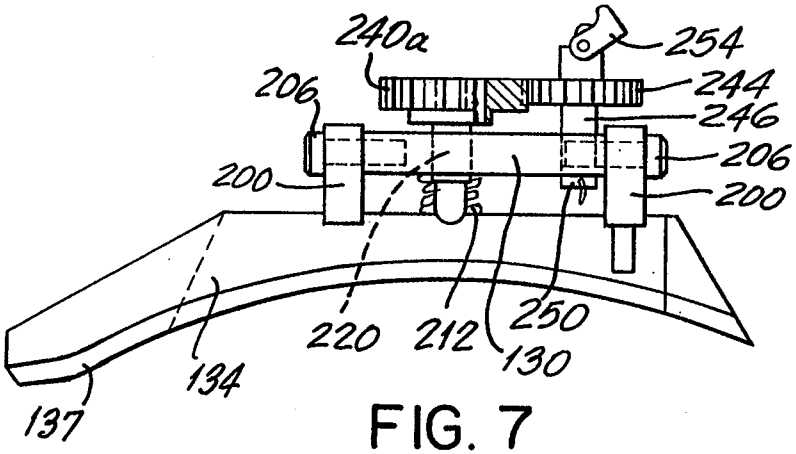
FIG. 7 is a side elevation view of a more preferred embodiment of the pressure applicator assembly using intermeshing spur gears connected to control rods.

As shown in FIG. 7, the support plate 130 fits between two upstanding, rectangular configured support mounts 200 that are received in slots 202 on the top surface of the pressure plate 134. Opposing bolts 206 extend through the sides of the support mounts 200 and into the support plate 130. The bolts can be threaded and dimensioned such that some clearance exists between the mounts 200 and the support plate 130 so that the pressure plate 134 can pivot and move relative to the mounts for changing the camber of the pressure plate 134 relative to the more stable and fixed support plate 130 and surface of the label transport drum. The support plate 130 can also include a central bolt coupler 210 which extends through the medial portion of the support plate and into the pressure plate. A spring 212 extends around the bolt coupler 210 and biases the pressure plate 134, which aids in preventing unnecessary rocking of the pressure plate 134 relative to the support plate 130.

Figure 8:
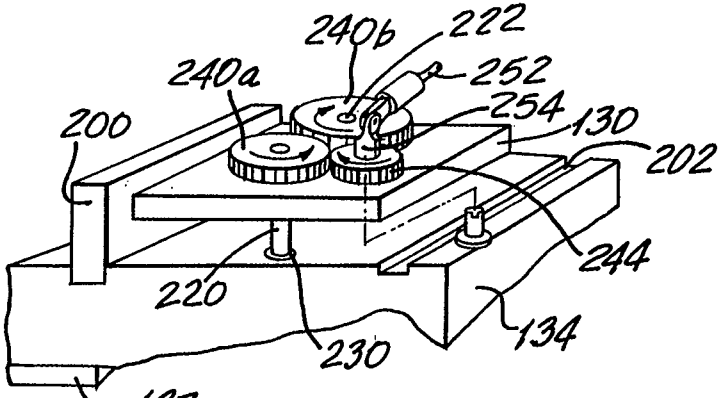
FIG. 8 is a pictorial view of a portion of the pressure plate and support plate of the second embodiment and showing in detail the gearing mechanism for moving the threaded rods against the pressure plate.

As shown in FIG. 8, two spaced threaded control rods 220, 222, extend through the support plate 130. Each rod 220, 222, has a rounded end portion that engages a rod receiving indentation 230 positioned on the top surface of the pressure plate 134. As illustrated, the two rods 220, 222 are spaced so that each one engages a respective side of the pressure plate 134. Both control rods 220, 222 have right handed threads. The other ends of the control rods 220,222 extend through the support plate 130. Each end has a spur gear 240*a*, 240*b* connected thereto. The gears 240*a*, 240*b*, which intermesh with each other. A pinion gear 244 is supported on a shaft 246 (FIG. 7) which extends through a bore opening of the support plate 130. A cotter pin 250 or other means prevents the shaft 246 from disengaging from the bore opening. The pinion gear 244 engages one of the spur gears 240*a*. A control shaft 252 and universal joint assembly 254 is connected to the pinion gear.

As is similar to the first embodiment, a flange and movable bracket assembly 260 (FIG. 9) are slidably mounted on the frame. The support plate 130 is secured by means such as bolts 262 to the flange and movable bracket assembly 260. The support plate 130 and pressure plate 134 may move as one unit toward and away from the surface of the label transport drum.

Figure 10:
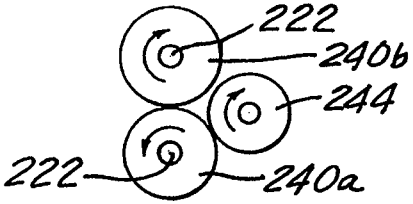
FIG. 10 is a schematic view showing the layout of the gear mechanism on the support plate.

In operation, the control shaft 252 is turned, which rotates the pinion gear 244. For purposes of explanation, the pinion gear 244 could turn in the clockwise direction as shown in FIG. 10. The pinion gear 244 rotates the spur gear 240*a* in the reverse, counter-clockwise direction. That spur gear 240 rotates the other, intermeshing spur gear 240*b* in the clockwise direction. Because both control rods are right handed threads, one control rod moves against the pressure plate 134, exerting more pressure against the plate, while the other control rod backs away, exerting less pressure. As a result the camber of the pressure plate 134 changes relative to the surface of the label transport drum.

METHOD OF OPERATION

In operation a strip 28 of label material is fed from the label supply roll 26*a*, through the dancer roll assembly 32 and into engagement with the label transport drum 42. The strip is cut, transferred to the drum, and retained to the drum surface 42 by a vacuum draw. An adhesive is applied by the adhesive applicator 60 onto the area adjacent the leading edge 21*a*. After adhesive application, the solvent is applied by the solvent delivery system 70 onto the area adjacent the trailing edge 21*b*.

Articles A are transferred along the serpentine transfer wheel assembly 100, and engage the downward extension of the pressure plate 134 to impart spin to the articles, which then move into engagement with the label transport drum 42. The article engaging surface 134*a* of the pressure plate 134 forms a retaining shield to maintain the articles on the drum as they are wrapped. Because the drum 42 rotates faster than the articles A moved between the pressure plate 134 and the drum 42, the advancing leading edge of the label having the adhesive applied adjacent thereto engages the article, forms an adhesive bond and secures the label directly to the article. Continued rotation of the drum maintains rotation of the article and wraps the article with the label. The labeled article then is transferred through a second timing wheel assembly 160 onto a conveyor 162, where the article is transferred into the oven 166. The label is heat shrunk onto the article A. Alternately, instead of a timing wheel assembly 160, a chain drive mechanism with receiving positions may be used.

If the labels are mismatched, i.e., the ends are unaligned, the control rod assembly is adjusted, or as in the second embodiment the control shaft 252 is turned, to change the camber of the pressure plate 134 and impart the desired pressure against selected sides and ends of the article so that the label is aligned correctly on each article as they are wrapped.

It should be understood that the foregoing description of the invention is intended merely to be illustrative thereof, and that other embodiments, modifications and equivalents may be apparent to those skilled in the art without departing from its spirit.

That which is claimed is:

1. An apparatus for applying thin film polymer labels to small cylindrical articles comprising:

a label transport drum, means for rotating said drum, along an article conveying direction, means for supplying a label to the surface of said label transport drum, means for applying an adhesive onto an area adjacent the trailing edge of the leading edge of said label while said label is moving with said drum, means for applying a solvent onto an area adjacent the trailing edge of said label while said label is moving with said drum, means for conveying cylindrically-configured articles into tangential spinning engagement with said drum so that the axis of the cylindrically configured articles is substantially perpendicular to the article conveying direction and into rotative engagement with adhesive on said leading edge of said label so as to transfer said label onto said article as said label is moved into engagement with said rotating article, said cylindrically-configured articles including opposing ends and a cylindrical surface forming a side with side surface portions adjacent the ends thereof, a pressure plate mounted adjacent the surface of said label transport drum and having an article engaging surface positioned adjacent the surface of said drum and side portions which engage the side surface areas of the article adjacent its ends for engaging and applying pressure to the articles as they are wrapped with the label, and including means for varying the camber of said pressure plate relative to articles conveyed on the surface of said drum so that as pressure is increased on a side portion of the article adjacent one end thereof, pressure is decreased on the opposite side portion adjacent the other end wherein a differential pressure is imparted against the areas of the article adjacent the ends of the article to prevent mismatching of the label ends as the label wraps around the article.

2. An apparatus according to claim 1 wherein said article engaging surface of said pressure plate includes a resilient material secured thereon that engages the article during label wrapping.

3. An apparatus according to claim 1 wherein said pressure plate includes means for moving the plate to and from the drum.

4. An apparatus according to claim 1 including a support plate spaced from the pressure plate opposite the article engaging surface and supporting said pressure plate in spaced relation from said drum surface.

5. An apparatus according to claim 4 including biasing means interconnecting said support and pressure plates.

6. An apparatus according to claim 4 including two, spaced threaded rods extending through said support plate, each rod having an end portion engaging a respective side of said pressure plate, and gear means for turning both rods simultaneously so that one rod moves against the pressure plate and the other rod moves in the reverse direction.

7. An apparatus according to claim 6 wherein said gear means includes two intermeshing spur gears connected to respective rods, and a pinion gear intermeshing with one of said spur gears.

8. An apparatus for applying thin film polymer labels to small cylindrical articles comprising:

a label transport drum;

means for rotating said drum along an article conveying direction;

means for supplying a label to the surface of said label transport drum;

means for applying an adhesive onto an area adjacent the leading edge of said label while said label is moving with said drum, a wiper member having a flexible solvent application tip positioned adjacent said label transport drum and engaging the trailing edge of a label while said label is moving with said drum so as to apply a predetermined amount of solvent onto the area adjacent the trailing edge of said label, means for conveying cylindrically configured articles into tangential spinning engagement with said drum so that the axis of the cylindrically-configured articles is substantially perpendicular to the article conveying direction, and into rotative engagement with said label and adhesive positioned thereon so as to transfer said label onto said article as said label moves with said drum and into engagement with said rotating article said cylindrically-configured articles including opposing ends and a cylindrical surface forming a side with side surface portions adjacent the ends thereof, a pressure plate mounted adjacent the surface of said label transport drum and having an article engaging surface positioned adjacent the surface of said drum and side portions which engage the side surface areas of the article adjacent its ends for engaging and applying pressure to the articles as they are wrapped with the label, and including means for varying the camber of said pressure plate relative to articles conveyed on the surface of said drum so that as pressure is increased on a site portion of the article adjacent one end thereof, pressure is decreased on the opposite side portion adjacent the other end wherein a differential pressure is imparted against the areas of the article adjacent the ends of the article to prevent mismatching of the label ends as the label wraps around the article,

9. An apparatus according to claim 8 wherein said pressure plate includes means for moving the plate to and from the drum.

10. An apparatus according to claim 8 wherein said article engaging surface of said pressure plate includes a resilient material secured thereon that engages the article during label wrapping.

11. An apparatus according to claim 8 including a support plate spaced from the pressure plate opposite the article engaging surface and supporting said pressure plate in spaced relation from said drum surface.

12. An apparatus according to claim 11 including biasing means interconnecting said support and pressure plates.

13. An apparatus according to claim 11 including two, spaced threaded rods extending through said support plate, each rod having an end portion engaging a respective side of said pressure plate, and gear means for turning both rods simultaneously so that one rod moves against the pressure plate and the other rod moves in the reverse direction.

14. An apparatus according to claim 13 wherein said gear means includes two intermeshing spur gears connected to respective rods, and a pinion gear intermeshing with one of said spur gears.

15. An apparatus for applying thin film polymer labels to small cylindrical articles comprising:

a frame, a label transport drum rotatably mounted on said frame, means for rotating said drum along an article conveying direction, means for supplying a label to the surface of said label transport drum, means for applying an adhesive onto an area adjacent the leading edge of said label while said label is moving with said drum, means for applying a solvent onto an area adjacent the trailing edge of said label while said label is moving with said drum, means for conveying cylindrically-configured articles into tangential spinning engagement with said drum so that the axis of the cylindrically-configured articles is substantially perpendicular to the article conveying direction, and into rotative engagement with said adhesive positioned on an area adjacent the leading edge of said label so as to transfer said label onto the article as said label is moved into engagement with said rotating article said cylindrically configured articles including opposing ends and a cylindrical surface forming a side with side surface portions adjacent the ends thereof, a support plate mounted for movement on said frame toward and away from said drum, a pressure plate carried by and spaced from said support plate, said pressure plate having an accurate article engaging surface and side positions which engage the side surface areas of the article adjacent its ends for engaging articles fed to the surface of said label transport drum, and including means for varying the camber of said pressure plate relative to articles conveyed on the surface of said drum so that as pressure is increased on a side portion of the article adjacent one end thereof, pressure is decreased on the opposite side portion adjacent the other end wherein a differential pressure is imparted against the areas of the article adjacent the ends of the article to prevent mismatching of the label ends as the label wraps around the article.

16. An apparatus according to claim 15 including two spaced, threaded rods extending through said support plate, each rod having an end portion engaging a respective side of said pressure plate, and gear means for turning both rods simultaneously so that one rod moves against the pressure plate and the other rod moves in the reverse direction.

17. An apparatus according to claim 15 wherein said gear means includes two intermeshing spur gears connected to respective rods, and a pinion gear intermeshing with one of said spur gears.

18. An apparatus according to claim 15 including means for moving said support and pressure plates as an assembly toward and away from said drum.

19. An apparatus according to claim 15 wherein said article engaging surface of said pressure plate includes a resilient material secured thereon that engages the article during label wrapping.

20. An apparatus according to claim 15 including biasing means interconnecting said support and pressure plates.

21. An apparatus for controlling the pressure applied to the sides and ends of a cylindrically,configured article conveyed along the surface of a label transport drum in an article conveying direction where the axis of the articles are substantially perpendicular to the direction of rotation during wrap around labelling of the article wherein the article has opposing ends and a cylindrical surface forming a side, comprising, a support plate adapted for mounting on a frame that rotatably supports a label transport drum, a pressure plate spaced from and carded by said support plate, said pressure plate having an arcuate configured article engaging surface, and side portions which are adapted to engage the side surface areas of an article adjacent its ends, and means for varying the camber of said pressure plate relative to articles conveyed on the surface of said drum so that as pressure is increased on a side portion of the article adjacent one end thereof, pressure is decreased on the opposite side portion adjacent the other end wherein a differential pressure is imparted against the areas of the article adjacent the ends of the article to prevent mismatching of the label ends as thee label wraps around the article.

22. An apparatus according to claim 21 including two spaced, threaded rods extending through said support plate, each rod having an end portion engaging a respective side of said pressure plate, and gear means for turning both rods simultaneously so that one rod moves against the pressure plate and the other rod moves in the reverse direction.

23. An apparatus according to claim 22 wherein said gear means includes two intermeshing spur gears connected to respective rods, and a pinion gear intermeshing with one of said spur gears.

24. An apparatus according to claim 21 wherein said article engaging surface of said pressure plate includes a resilient material secured thereon that engages the article during label wrapping.

25. A method of applying thin film polymer labels onto small cylindrical articles comprising, feeding a thin film polymer label onto a label transport drum, applying an adhesive onto an area adjacent the leading edge of the label, applying a predetermined amount of solvent onto an area adjacent to the trailing edge of the label, conveying small cylindrical articles into engagement, transferring the label onto the conveyed small cylindrical article by moving the leading edge of the label into engagement with the article so that the adhesive adheres the leading edge of the label to the article, and then wrapping the article with the label so that the trailing edge of the label overlaps the leading edge, while also biasing a pressure plate into engagement with the article wherein the pressure plate is mounted adjacent the surface of the label transport drum and has an article engaging surface positioned adjacent the surface of said drum and side portions which engage the said surface areas of the article adjacent its ends, and varying the camber of the pressure plate relative to articles conveyed on the surface of the drum so that as pressure is increased on a side portion of the article adjacent one end thereof, pressure is decreased on the opposite side portion adjacent the other end wherein a differential pressure is imparted against areas of the article adjacent the ends of the article to prevent mismatching of the label ends as the label wraps around the article.

26. A method according to claim 25 including the step of applying overall heating to the wrapped article to heat shrink the label onto the article.

27. A method of applying thin film polymer labels onto small cylindrical articles comprising, feeding a thin film polymer label onto a label transport drum, applying an adhesive onto an area adjacent the leading edge of the label, applying a predetermined amount of solvent onto an area adjacent the trailing edge of the label by deflecting a flexible tip of a rotating solvent wiper member against the area adjacent the trailing edge of the label while rotating the wiper member so that the tip moves at a surface speed different from the surface speed of the label transport drum, transferring the label onto a small cylindrical article by rolling the article into engagement with the adhesive on the leading edge of the label so that the adhesive adheres the leading edge of the label to the article, and then wrapping the article with the label so that the trailing edge overlaps the leading edge while also biasing a pressure plate into engagement with the article, wherein the pressure plate is mounted adjacent the surface of the label transport drum and has an article engaging surface positioned adjacent the surface of said drum and side portions which engage the side surface area of the article adjacent it sends, and varying the camber of the pressure plate relative to articles conveyed on the surface of the drum so that as pressure is increased on a side portion of the article adjacent one end thereof, pressure is decreased on the opposite side portion adjacent the other end wherein a differential pressure is imparted against areas of the article adjacent the ends of the article to prevent mismatching of the label ends as the label wraps around the article.

28. A method according to claim 27 including the step of applying overall heating to the wrapped article to heat shrink the label onto the article.

* * * * *